United States Patent [19]

Bernardi et al.

[11] 4,346,851

[45] Aug. 31, 1982

[54] DEVICE FOR AUTOMATICALLY SHREDDING THIN SHEETS

[75] Inventors: Herbert Bernardi, Haag; Gerd von Aschwege, Munich, both of Fed. Rep. of Germany

[73] Assignee: G.A.O. Gesellschaft für Automation und Organisation mbH, Fed. Rep. of Germany

[21] Appl. No.: 115,120

[22] Filed: Jan. 24, 1980

Related U.S. Application Data

[62] Division of Ser. No. 867,011, Jan. 5, 1978, Pat. No. 4,236,639.

[30] Foreign Application Priority Data

May 1, 1977 [DE] Fed. Rep. of Germany ..... 2729830

[51] Int. Cl.[3] ..... B02C 4/42

[52] U.S. Cl. ..... 241/159; 83/302; 83/500; 241/223; 241/236

[58] Field of Search ..... 241/158, 159, 222–225, 241/235, 236; 83/500–503, 408, 302; 271/303, 305

[56] References Cited

U.S. PATENT DOCUMENTS

| | | | |
|---|---|---|---|
| 3,529,782 | 2/1967 | Liebman | 241/236 |
| 3,894,697 | 7/1975 | Lawson et al. | 241/236 X |
| 4,068,805 | 1/1978 | Oswald | 241/236 X |
| 4,166,030 | 8/1979 | Lewis et al. | 271/303 X |

*Primary Examiner*—Mark Rosenbaum
*Assistant Examiner*—Timothy V. Eley
*Attorney, Agent, or Firm*—McGlew & Tuttle

[57] ABSTRACT

A shredder device for selectively shredding paper sheets, such as bank notes, in the form of an interchangeable module for a conveying system includes a conveyor movably mounted within the module, means disposed along a feed path for directing selected sheets onto the conveyor and a pair of shredding cylinders mounted rotatably in the module so as to receive and shred sheets mounted on the conveyor.

6 Claims, 2 Drawing Figures

DEVICE FOR AUTOMATICALLY SHREDDING THIN SHEETS

CROSS-REFERENCE TO RELATED APPLICATIONS

The present application is a divisional of Ser. No. 867,011 filed Jan. 5, 1978, now U.S. Pat. No. 4,236,639.

FIELD AND BACKGROUND OF THE INVENTION

This invention relates in general to shredder devices and, more particularly, to a new and useful shredder construction for automatically sorting and shredding thin paper sheet items such as valuable papers, currency and bank notes which includes a modular housing having a means for sequentially receiving the items and selectively diverting and shredding sheets.

A device is known from German published application (DT-OS) No. 2634375 (U.S. Pat. No. 4,166,030) in which a shredder is provided at the end of a secondary transportation path which branches off of a main path. The destruction of items, more particularly pieces of paper money or bills, which are no longer fit for circulation but otherwise genuine, immediately at or in the sorting device has decided advantages since the sorted bills would otherwise require the same expensive security needed for handling genuine bills until their final destruction. At any rate, there is a possibility that the money or bills sorted out in this manner might be fraudulently manipulated during transport from the sorting device to equipment for demonetizing the bills or to a furnace. The problem is not completely solved even with the known shredder which is integrated in the sorting device. Upon leaving the belt transportation system of the known device, the bills sorted out for unfitness are directed or fall past a light sensor and then pass between interengaging shredding cylinders of the shredder where they are cut to 2.5 mm wide strips. The bills leaving the transportation system might therefore be branched off before they enter the shredder, and thus be saved from destruction. In the prior art device, it has been attempted to eliminate this possibility by accommodating the entire shredder in a closable housing which is usually locked to prevent fraudulent manipulation. It is evident that even if such a measure is useful, however, it is not totally satisfactory.

SUMMARY OF THE INVENTION

The invention is directed to a shredder arrangement of the above-mentioned kind, for eliminating any possibility of manipulating the bills sorted out for unfitness on their way to the shredding cylinders.

In accordance with the invention, a shredder device is provided for selectively shredding paper sheets, such as bank notes. The shredder device includes a housing having an inlet opening for sequentially receiving the sheets and an outlet opening. Means are provided within the housing for transporting the sheets through a first feed path between the inlet and the outlet openings. A conveyor means movably mounted within the housing is disposed along the first feed path for selectively and alternatively directing sheets through a second feed path. Drive means are provided for driving the conveyor means. A pair of shredding cylinders is rotatably mounted in the housing along the second feed path in parallel and define a nip therebetween for receiving the sheets carried on the conveyor means and shredding the sheets. The pair of shredding cylinders are operatively connected to the conveyor means such that the shredding cylinders rotate as the conveyor means is driven. This insures that any unfit bill once sorted out is positively fed to the shredding cylinders and a fraudulent manipulation of the bills is not possible. Thus, the inventive shredder device is particularly suited for an automatic sorting system in which thin sheet items, particularly valuable papers, currency, and the like are individually drawn as sheets from a stack, exmained for various criteria, and depending on the result of the examination, assigned to definite sorting classes, one of which encompasses items which must be shredded.

In accordance with a preferred embodiment of the invention, the shredder device includes a second pair of shredding cylinders mounted rotatably in the housing in parallel and disposed transversely to the first mentioned pair of shredding cylinders for receiving therebetween shredded sheets from the first mentioned cylinders, and the second pair of shredding cylinders are operative to further shred the shredded sheets. In accordance with further features of the invention the conveyor means is driven at a speed equal to the tangential speed of the first mentioned shredding cylinders and the second shredding cylinders are operative rotate at a slower speed than the first mentioned pair of shredding cylinders. Consequently, advantages of the inventive shredder include the cutting of the bills into thin sheets at the speed of the overall conveying system and the subsequent cutting of strips leaving the first pair of shredding cylinders in order to make a recomposition of the shredded sheets impossible. It is a further advantage of the invention that the difference in speeds of the first and second pairs of cylinders results in a further mixing and local displacement of the shredded sheets.

It is a further object of this invention to provide a shredder device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
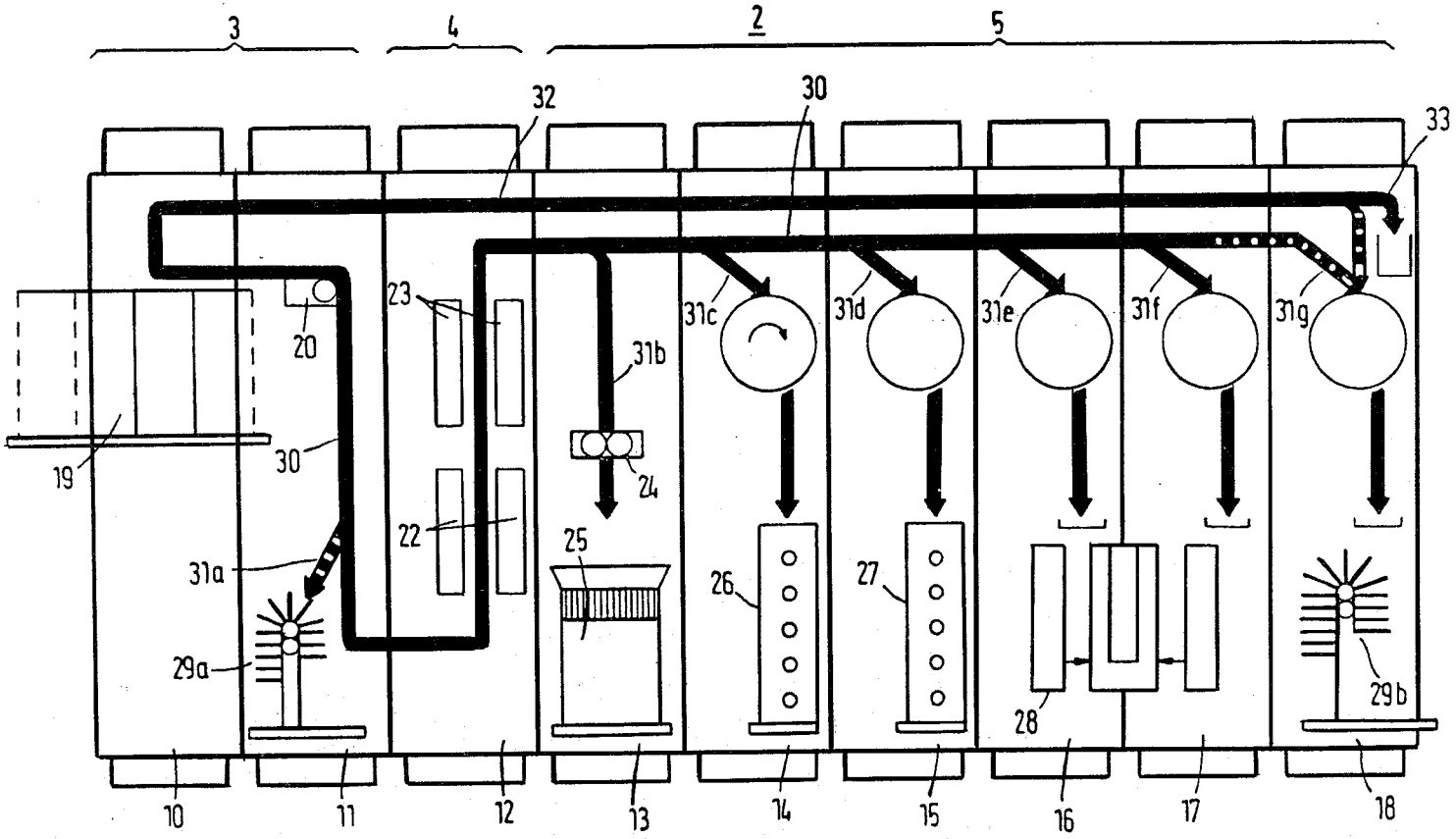
FIG. 1 is a schematic view of a sorting assembly including a shredder, in accordance with the invention, as an integrated sub-assembly.

Referring to the drawings in particular, the invention embodied therein comprises a shredder device for automatically sorting and shredding thin paper sheets such as valuable papers, currency, bank notes and the like which includes a modular housing or module for sequentially receiving individual sheets withdrawn from a stack and tested for various characteristics. The sheets, depending upon the results of the examination, are assigned to definite sorting classes which may include, for example, genuine items or bills which can no longer be circulated and, therefore, are directed by a conveying system to a shredder for destruction. FIG. 1 illustrates a conveyor unit 2, a receiving and readying unit 3, and a testing unit 4. The conveyor 2 is a purely mechanical system unit and is responsible for the movement of packets of the thin sheets such as bank notes, which are held together with straps. The receiving and readying unit 3 receives input packets of bank notes which are packed in magazines and withdraws the packets one at a time from the magazine, and removes the straps. The bank notes are then separated and fed from the stacks and are passed, by means of a bank note conveying system, through the testing unit 4 where each bank note is individually verified and tested for its condition with the aid of a plurality of testing devices. The testing unit 4 is followed by a sorting unit 5 which sorts the sheets into different categories which may typically include a category of notes which are to be shredded.

The conveying unit 2 of the exemplary embodiment shown in FIG. 1 includes nine building blocks or modules designated by reference numerals 10 through 18, which may be more particularly described as follows:

A module 10 for separating and unstrapping the bill packs supplied in locked pack magazines 19;

A module 11 for separating individual bills from the unstrapped bill stacks by means of a separating device 20, and for predetermining which of the bills, upon passing through conveying unit 2, might damage subsequent units and, if necessary, directing such bills into a first rejection magazine 29*a;*

A module 12 for examining the bills for fitness (general condition, for example, degree of contamination) in a first test section 22, and for genuineness (bills are suspected of being counterfeit because of defective or absent authenticity marks) in a second checking section 23;

A module 13 for irreversibly destroying genuine but unfit (noncirculatable) bills by means of a double shredder system 24, and for collecting the shreds produced in a shred container 25;

Two identically designated modules 14, 15 operating in tandem, for stacking and depositing unfit bills without straps in corresponding containers 26, 27;

Two identically designed modules 16, 17, also operating in tandem, for stacking and depositing fit bills with straps, in a strapping station 28; and A module 18 for returning bills to be processed separately, including the corresponding strap, into a second rejection magazine or manual reprocessing magazine 29*b*, and for collecting straps which belong to packs not having rejected bills.

The entire system is modular. All modules 10-18, by which the bills, straps or bill packs are conveyed, examined and sorted, are uniform in construction, that is, standardized with respect to both their mechanically and their electrical interfaces. This makes it possible to individually select and combine the modules of the conveying unit and to adapt the conveying unit to different patterns of bill treatment and to the specific characteristics of various types of bills and currencies.

As shown by the flow lines in FIG. 1, conveying unit 2 comprises two conveying systems, a system 30 for conveying bills, and a system 32 for conveying straps, which are independent of each other and extend through all of the modules 10-18.

The bill transportation system 30 conveys the individual bills, starting from the separation of the individual packs from pack magazine 19 in module 10, through module 11 and the individual testing stations 22, 23 of module 12, to the respective destinations in sorting modules 13-18, as determined in the testing stations. As indicated by the branches 31*b* to 31*g* within sorting modules 13 to 18, respectively, the path along which the individual bills are transported may vary considerably in length, depending upon the sorting module in which they are deposited. This imposes particular requirements on transport and monitoring.

In addition to the sorting branches 31*b* to 31*g* provided in sorting modules 13-18, another branch 31*a* is already provided at the beginning of the bill transportation path in module 11. This is where those bills are sorted out which might cause damage in the downstream units.

The strap conveying system 32, which as shown in FIG. 1 is provided above the bill conveying system 30, also starts in module 10. However, unlike the bill conveying system 30, the strap conveying system has a branch 33 only in the last module 18.

Figure 2:
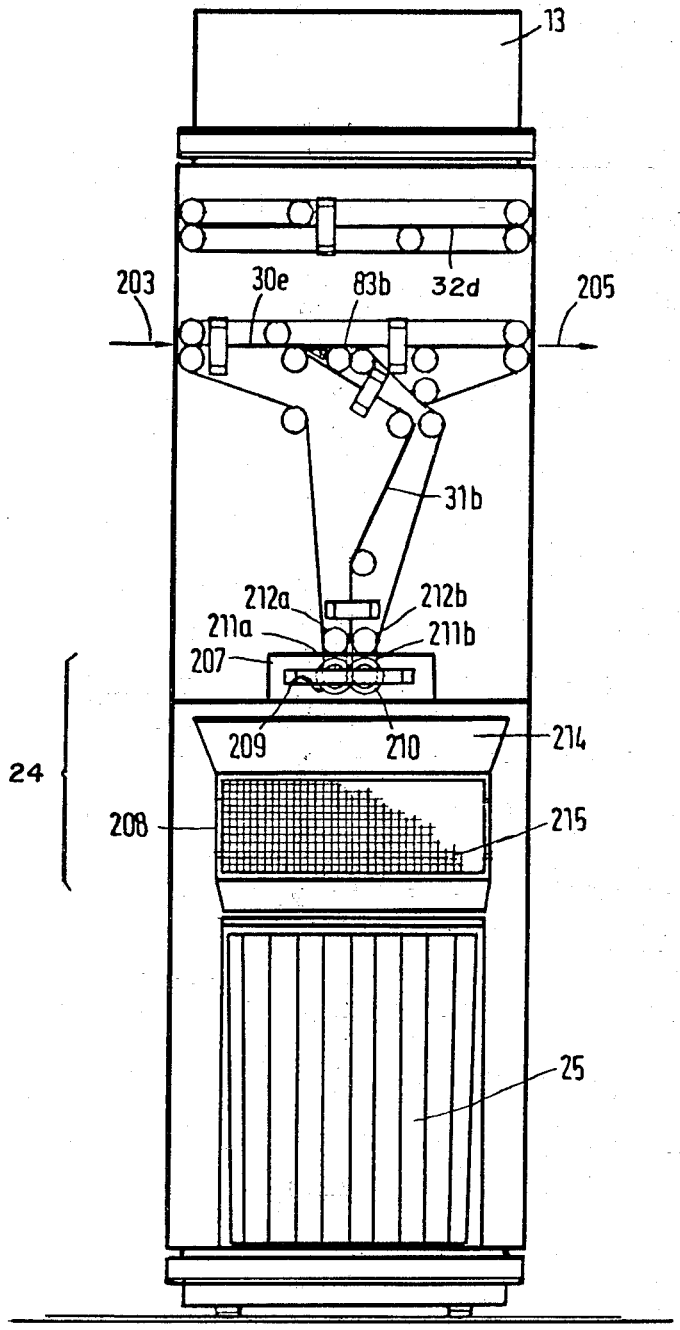
FIG. 2 is a schematic side elevation view of a module including the shredder according to the invention.

FIG. 2 illustrates the details of module 13 which includes the shredder 24 for irreversibly and completely destroying the bills which, in the preceding testing sections 22, 23 of module 12, have been identified as genuine but found unfit for further circulation. The tested bills enter a conveying section 30*e* of the module 13 at a location indicated by arrow 203. Immediately after their entry, they pass through a sorting gate 83*b* which alternately directs the bills, in response to a signal received from a conveyor control unit (not shown), identified as fit for circulation in the testing sections 22, 23 of preceding module 12 to continue along the same path or conveying section 30*e*, in the direction of arrow 205, to the next module 14 and the bills identified as unfit for circulation via a conveying section 31*b* to a double shredder system 24 for destruction.

Module 13 may be employed alternatively or in combination with the two following modules 14, 15. In modules 14, 15 the bills unfit for circulation may be collected in stacks, in an amount to be chosen, without destruction.

In the following, the double shredder system 24 of module 13 is explained in more detail.

As is particularly shown in FIG. 2, the shredder 24 comprises two shredder systems 207 and 208 mounted one above the other. The first system 207 includes two interengaging rotary shredding cylinders 209, 210. The first system 207 receives the bills directly from conveying section 31*b* and cuts them into narrow elongated strips. Since shredding cylinders 209, 210 are directly connected, by bridging elements in the form of belt 211*a*, 211*b*, to pulleys 212*a* , 212*b* of conveying section 31*b*, shredding cylinders 209, 210 rotate at the speed of transportation of the other system. Stated otherwise, the speed of the conveying system 31*b* corresponds to the tangential speed of the shredding cylinders 209, 210. In addition, the direct connection of the first system 207 to conveying section 31*b*, ensures that the bills intended for module 13 will be securely conveyed through the first system. Consequently, no bills can be lost without detection.

The first shredder system 207 is followed by a second shredder system 208 which receives the elongated strips supplied at the speed of transportation through a funnel-shaped charging hopper 214 and which shreds them into shreads of a very small size. As shown in FIG. 2, the shredding cylinders 215 (one shown) of the second shredder system are disposed transversely to shredding cylinders 209, 210 of the first system and one behind the other, as viewed in the figure. Shredder cylinders 215 rotate at a slower speed than the cylinders of the first system. The supplied strips are thereby intentionally mixed. To avoid accumulations, which can jam the shredder, larger cylinders are used, so that the throughput capacity of the second system is substantially higher than that of the first system, and the speed difference is compensated. The second system 208 also cuts the bill strips longitudinally and transversely. The shreds leaving the second system are collected in a shred container 25. As noted above, a portion 32*d* of the strap conveying system extends through module 13.

Due to the minimum size of the shreads, the packing density of the container is permanently high, which is a great advantage for further processing, for example, for transport to a furnace. Since the shreds, after having passed through the double cylinder system 24 have a size of not more than a few square millimeters, the possibility of a fraudulent use of the contents of the shred container can be ruled out with an absolute certainty.

The shred container 25 is exchangeable.

While specific embodiments of the invention have been shown and described in detail to illustrate the application of the principles of the invention, it will be understood that the invention may be embodied otherwise without departing from such principles.

What is claimed is:

1. In a device for shredding thin paper sheets, such as bank notes, which sheets have been sorted out in an automatic sorting device in which the individual sheets are withdrawn from a stack, are tested for a plurality of criteria and are assigned to certain sorting classes, depending on the test results, one of these sorting classes being that of genuine bank notes which are no longer fit for circulation, an improvement comprising:

a housing having an inlet opening for sequentially receiving the sheets and an outlet opening;

means within said housing for transporting the sheets through a first feed path between said inlet and said outlet openings;

conveyor means movably mounted in said housing having one end disposed along said first path for selectively receiving and directing sheets through a second path to an opposite end of said conveyor means, said conveyor means having end rollers at its opposite end;

sorting means connected to said means for transporting the sheets for selecting sheets to be received by said conveyor means;

a pair of shredding cylinders rotatably mounted in said housing in parallel along said second feed path and at a location spaced from said opposite end of said conveyor means, said pair of shredding cylinders defining a nip therebetween for receiving the sheets directed by said conveyor means and shredding the sheets;

drive means connected to said conveyor means for driving said conveyor means; and bridging elements connected between said pair of shredding cylinders and said conveyor means and rollers for confining and establishing a closed continuous transition in said second feed path between said conveyor means and said nip;

said drive means of said conveyor means operable to also drive said shredding cylinders.

2. The shredder device of claim 1, further comprising a second pair of shredding cylinders mounted rotatably in said housing in parallel and disposed transversely to said first mentioned pair of shredding cylinders for receiving therebetween shredded sheets from said first mentioned cylinders, said second pair of shredding cylinders being operative to further shred said shredded sheets.

3. The shredder device of claim 2, wherein said second pair of shredding cylinders are operative to rotate at a slower speed than said first mentioned pair of shredding cylinders.

4. The shredder device of claim 3, wherein said second pair of shredding cylinders are dimensioned for a higher throughput of sheets than said first mentioned pair of shredding cylinders.

5. The shredder device of claim 4, further comprising a charging hopper having an inlet opening at one end for receiving material from said first mentioned pair of shredding cylinders and an outlet opening at another end for delivering the same to said second pair of shredding cylinders.

6. The shredder device of claim 1, wherein said bridging elements comprise endless belts connected around each conveyor means end roller and a respective one of said pair of said shredding cylinders, said shredding cylinder and end rollers chosen to have a size so that a tangential speed of said shredding cylinders equals a translational speed of said belts and the movement of sheets of said second feed path.

* * * * *